US009412345B2

(12) United States Patent
Johns et al.

(10) Patent No.: US 9,412,345 B2
(45) Date of Patent: Aug. 9, 2016

(54) ADJUSTABLE ZERO FRET AND METHOD OF USE ON A STRINGED INSTRUMENT

(71) Applicant: Gibson Brands, Inc., Nashville, TN (US)

(72) Inventors: Frank Johns, Hermitage, TN (US); George Mathews, Mt Juliet, TN (US); John Steve Frensley, Lebanon, TN (US)

(73) Assignee: Gibson Brands, Inc., Nashville, TN (US)

( * ) Notice: Subject to any disclaimer, the term of this patent is extended or adjusted under 35 U.S.C. 154(b) by 0 days.

(21) Appl. No.: 14/992,756

(22) Filed: Jan. 11, 2016

(65) Prior Publication Data

US 2016/0196807 A1 Jul. 7, 2016

Related U.S. Application Data

(63) Continuation of application No. 14/715,365, filed on May 18, 2015, now abandoned, which is a continuation of application No. 14/092,181, filed on Nov. 17, 2013, now abandoned.

(60) Provisional application No. 61/731,026, filed on Nov. 29, 2012.

(51) Int. Cl.
*G10D 3/06* (2006.01)
*G10D 3/12* (2006.01)

(52) U.S. Cl.
CPC ... *G10D 3/06* (2013.01); *G10D 3/12* (2013.01)

(58) Field of Classification Search
CPC ..... G10D 3/12; G10D 3/06
See application file for complete search history.

(56) References Cited

U.S. PATENT DOCUMENTS

| | | | | | |
|---|---|---|---|---|---|
| 1,599,184 | A | * | 9/1926 | Polychronis | G10D 3/12 84/314 R |
| 3,429,214 | A | * | 2/1969 | Jones, Sr. | G10D 3/12 84/314 N |
| 3,515,025 | A | * | 6/1970 | Appleton | G10D 3/12 84/314 N |
| 3,599,524 | A | * | 8/1971 | Jones | G10D 3/12 84/271 |
| 4,295,404 | A | * | 10/1981 | Smith | G10D 3/00 84/314 N |
| 4,304,163 | A | * | 12/1981 | Siminoff | G10D 3/12 84/307 |
| 4,669,350 | A | * | 6/1987 | Gressett, Jr. | G10D 3/12 84/314 N |
| 5,481,956 | A | * | 1/1996 | LoJacono | G10D 3/12 84/314 N |

(Continued)

*Primary Examiner* — Robert W Horn
(74) *Attorney, Agent, or Firm* — Bates & Bates, LLC

(57) ABSTRACT

An apparatus and method of varying the tonal aspects of a string instrument such as an acoustic or electric guitar is disclosed. The apparatus and method employing a unique zero fret assembly. The zero fret assembly includes an upper portion and a lower portion. The lower portion is configured to connect with a fret board, headstock or body of an instrument. The upper portion is configured to engage the lower portion. The upper portion is also configured to receive and support an instrument's strings. The upper portion is selectively movable relative to the lower portion by an operator to change the tonal nature of the instrument.

16 Claims, 5 Drawing Sheets

(56) References Cited

U.S. PATENT DOCUMENTS

| | | | | | |
|---|---|---|---|---|---|
| 5,492,044 | A * | 2/1996 | Sperzel | G10D 3/04 | 84/297 R |
| 5,589,653 | A * | 12/1996 | Rose | G10D 3/14 | 84/297 R |
| 5,696,336 | A * | 12/1997 | Sperzel | G10D 3/04 | 84/297 R |
| 5,750,910 | A * | 5/1998 | LoJacono | G10D 3/12 | 84/314 N |
| 6,156,962 | A * | 12/2000 | Poort | G10D 3/06 | 84/314 N |
| 6,433,264 | B1 * | 8/2002 | Gimpel | G10D 3/12 | 84/314 N |
| 6,462,259 | B1 * | 10/2002 | Chapman | G10D 3/12 | 84/314 N |
| 6,583,346 | B2 * | 6/2003 | Lojacono | 84/314 N | |
| 6,706,957 | B1 * | 3/2004 | Merkel | G10D 3/12 | 84/314 N |
| 7,256,336 | B2 * | 8/2007 | Muncy | G10D 3/06 | 84/314 N |
| 7,327,109 | B1 * | 2/2008 | Hagen | G10D 3/04 | 318/298 |
| 8,354,578 | B2 * | 1/2013 | Decker | G10D 3/12 | 84/314 N |
| 8,653,345 | B1 * | 2/2014 | Rogers | G10D 3/06 | 84/314 N |
| 2014/0216230 | A1 * | 8/2014 | Johns | G10D 3/06 | 84/314 R |
| 2015/0248875 | A1 * | 9/2015 | Johns | G10D 1/085 | 84/314 R |

* cited by examiner

ADJUSTABLE ZERO FRET AND METHOD OF USE ON A STRINGED INSTRUMENT

CROSS-REFERENCE TO RELATED APPLICATIONS

The present application claims the benefit of currently pending U.S. patent application Ser. No. 14/715,365; which claims the benefit of U.S. patent application Ser. No. 14/092,181; which claims the benefit of U.S. Provisional Patent Application No. 61/731,026; titled Adjustable Zero Fret and Method of Use on a Stringed Instrument, filed on Nov. 29, 2012, the entire contents of which are all herein incorporated by reference and made a part hereof.

FIELD OF THE INVENTION

The present invention relates to an adjustable zero fret device, and specifically to an adjustable zero fret device for use with stringed instruments.

BACKGROUND

A zero fret is typically a fret-like device placed at the headstock end of the neck of a stringed instrument, such as, without limitation, a banjo, guitar, mandolin, or bass guitar. A function of the zero fret is that it holds the strings a desired distance above the other frets on the instrument's fret board. Typical zero frets are either static and, therefore, can't be adjusted to selectively modify the tonal quality of the instrument or overly complex in their construction and use.

An adjustable zero fret that is effective in modifying tonal quality and easy to use is desired.

SUMMARY

In an illustrative embodiment, an adjustable zero fret assembly for a stringed instrument includes a base portion. The base portion defines a substantially U-shaped locator channel extending substantially a length of the base portion. The fret assembly also includes a single piece adjustable portion selectively movable relative to said base portion along a locator post formed in the single piece adjustable portion. The locator post is configured to engage the locator channel. The single piece adjustable portion includes at least one seat portion for receiving a string of the stringed instrument. Also, the at least one seat portion includes a contact surface, and a mechanical device for selectively moving the adjustable portion either toward or away from the base portion.

In another illustrative embodiment, a method of varying the tonal quality of a stringed instrument. The method includes providing a stringed instrument having at least two strings playable to produce a tonal sound where the stringed instrument has an initial tonal quality. Additionally, providing a two piece adjustable zero fret assembly adjacent the at least two strings. The two piece adjustable zero fret assembly includes a base portion having a substantially U-shaped locator channel formed in the base portion and extending substantially a length of the base portion. Also included is a single piece adjustable portion that has a locator post formed in the single piece adjustable portion. The locator post is configured to engage the locator channel and the single piece adjustable portion is selectively moveable relative to the base portion. The method also includes providing a biasing force to the at least two strings by selectively moving single piece adjustable portion in a direction toward or away from the at least two strings to produce a second tonal quality.

In yet another illustrative embodiment, a stringed instrument, comprising a body and a neck having a first end and a second end, the neck is connected with the body adjacent the first end. Also included is a head, the head is connected with the neck adjacent the second end. Additionally included is at least one string extending between the head and the body, along the neck. A two-piece adjustable zero fret assembly includes a base portion. The base portion defines a locator channel extending substantially a length of the base portion. Also included is a single piece adjustable portion selectively movable relative to said base portion along a locator post formed in the single piece adjustable portion. The locator post is configured to engage the locator channel. The single piece adjustable portion includes at least one seat portion for receiving a string of the stringed instrument. Also, the at least one seat portion has a contact surface, and a mechanical device for selectively moving the adjustable portion either toward or away from the base portion.

This summary is not intended to identify key or essential features of the claimed subject matter, nor is it intended to be used as an aid in limiting the scope of the claimed subject matter.

Other principal features of the current disclosure will become apparent to those skilled in the art upon review of the following drawings, the detailed description, and the appended claims.

BRIEF DESCRIPTION OF THE DRAWINGS

Illustrative embodiments will be described referring to the accompanying drawings, wherein like numerals denote like elements.

DETAILED DESCRIPTION

The device is described with reference to the accompanying Figures. In all Figures, like numerals correspond to like elements. The device is directed to an apparatus and method for selectively modifying the tonal character of an acoustic or electric stringed instrument using an adjustable zero fret assembly. One illustrative embodiment of an adjustable zero fret assembly, designated 100, is illustrated in FIGS. 1-10. Specific details of the device and its use are disclosed more completely below.

By way of background, the term "stringed instrument" is intended to be directed to a wide variety of stringed instruments. Suitable, non-limiting examples include acoustic guitar, electric guitar, acoustic bass guitar and electric bass guitar, banjo, mandolin, and similar type instruments. Although the Figures depict a six-stringed instrument, the scope of this disclosure includes instruments with more or fewer strings.

Figure 1:
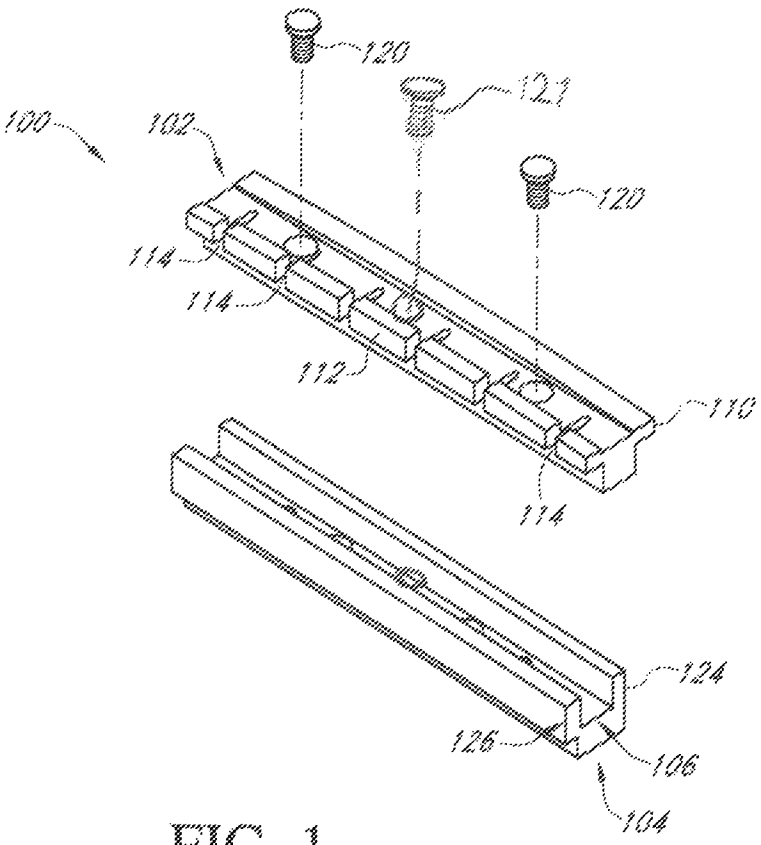
FIG. 1 is an exploded isometric view of the adjustable zero fret assembly.
Figure 3:
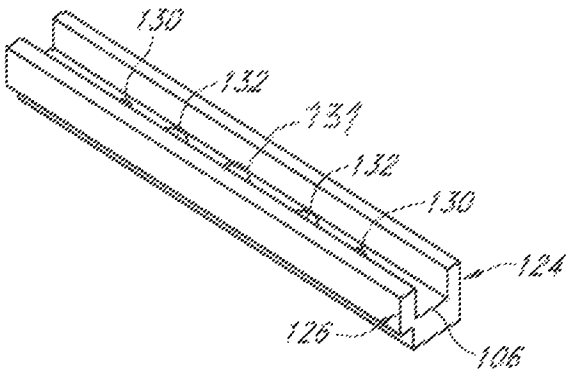
FIG. 3 is an isometric view of a lower portion of the adjustable zero fret assembly.
Figure 2:
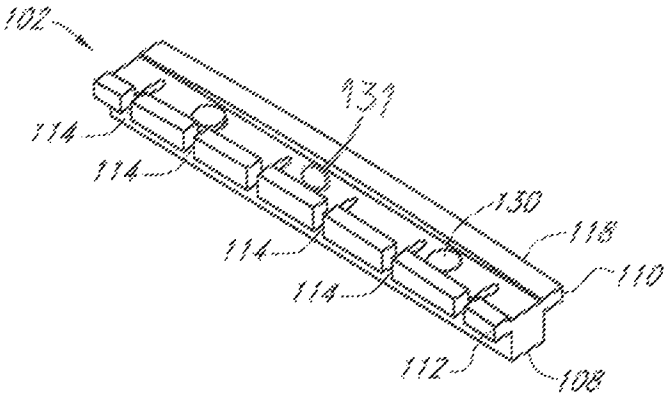
FIG. 2 is an isometric view of an upper portion of the adjustable zero fret assembly.
Figure 5:
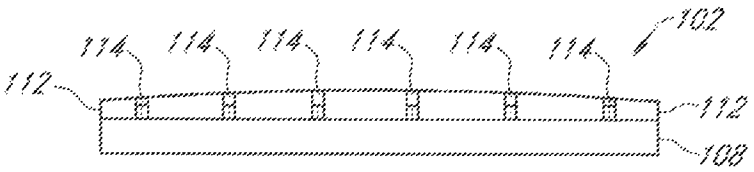
FIG. 5 is a frontal plan view of the upper portion of the adjustable zero fret assembly.
Figure 4:
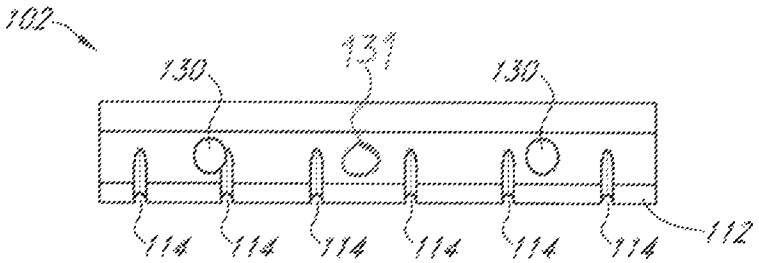
FIG. 4 is a top plan view of the upper portion of the adjustable zero fret assembly.
Figure 7:
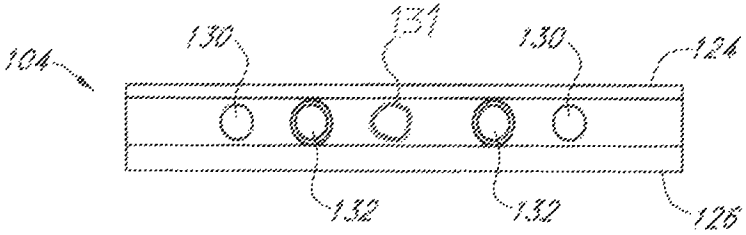
FIG. 7 is a top plan view of the lower portion of the adjustable zero fret assembly.
Figure 6:
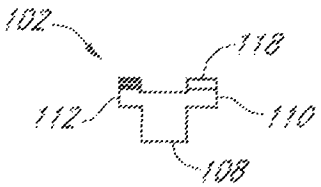
FIG. 6 is an end plan view of the upper portion of the adjustable zero fret assembly.
Figure 8:
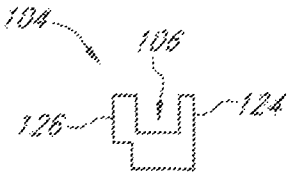
FIG. 8 is an end plan view of the lower portion of the adjustable zero fret assembly.

Referring to FIGS. 1-3, an adjustable fret assembly 100 is depicted. The adjustable fret assembly 100 includes a base portion 104 which is substantially an elongated U-shaped element. The base portion 104 includes a locator channel 106 defined by opposed parallel lower portion first support 124 and second lower second support 126. (best seen in FIGS. 3 and 7-8). The base portion 104 is configured to form a base element for the adjustable zero fret assembly 100. In use, the base portion 104 rest on the fret board, neck, or body of a stringed instrument at a desired location.

In an illustrative embodiment, the base portion 104 includes at least one fastener bore 132 extending therethrough to enable the lower portion to be fixedly attached to the fret board or neck of an instrument. Suitable fasteners include, without limitation, screws (not shown) or the like. Similarly, adhesives or other known fastening means may also be incorporated without exceeding the spirit and scope of this disclosure. In another illustrative embodiment, the base portion does not include a fastener bore 132. In such instances, the adjustable zero fret assembly 100 is held in place by the instrument's strings. In this manner, the adjustable zero fret assembly 100 may be removed easily and without harm to the instrument fret board or neck.

In an illustrative embodiment, the adjustable zero fret assembly 100 also includes an adjustable portion 102. The adjustable portion 102 is a substantially elongated T-shaped element. The adjustable portion 102 includes a locator post 108 and opposed first flange portion 110 and second flange portion 112. The locator post 108 is configured to engage and when in use, is positioned within the locator channel 106. The tolerance between the locator post 108 and the locator channel 106 is such that the locator post 108 may be inserted and removed into the locator channel 106 as needed. However, once inserted, the tolerance between the two pieces is sufficiently minimal that any non-user activated relative movement between the respective parts is mostly eliminated.

In another illustrative embodiment, as best seen in FIGS. 2 and 4-6, the adjustable portion 102 includes opposed first flange portion 110 and second flange portion 112. The first flange portion 110 is configured with a number of seats 114. Each seat 114 is configured to receive one string of the instrument. As shown, the seats 114 are all the same size. However, the size and shape of the seats is variable. In an embodiment, the size, shape, spacing and general location of the seats 114 is based on the diameter of the instrument string and type of instrument. By way of non-limiting example, the Figures depict a configuration as one might find used with a six-string guitar.

The adjustable portion 102 also includes a second flange portion 112. The second flange portion 112 typically does not have any seats 114. However, it is considered within the scope of this disclosure to have a second flange portion that includes seats 114. (Not shown). The second flange portion typically does include a crown 118, although not necessarily. The crown 118 is configured to provide support for any strings passing over it. The crown also limits the contact surface area with the string so as to not adversely affect the tonal quality or cause undue string wear.

In operation, the base portion 104 is attached to the fret board 156 at, for example, a zero fret location. In one example, screws (not shown) are driven through the fastener bores 132 of the base portion 104 into the neck of the instrument. The adjustable portion 102 is positioned such that the locator post 108 is inserted into the locator channel 106. The adjustable portion 102 is held relative to the base portion 104 via adjustment fasteners 120 passing through the adjustable portion 102 and into the base portion 104. The adjustment fasteners 120 are configured to allow for very controlled user activated relative movement between the adjustable portion 102, the base portion 104, and when in use, the string 154. One suitable non-limiting example of an adjustment fastener 120 of interest is a machine screw or the like. A string(s) is placed over the adjustable fret assembly 100 such that each string 154 is positioned in a respective seat. From there, the instrument may be strung as one normally would set-up such an instrument.

The instrument is tuned in a normal fashion if desired. Also, the tonal quality of the instrument is selectively modified by engaging the adjustment fasteners 120 to either move the adjustable portion 104 closer to the base portion 104 or vice versa. In other words, in use, moving the adjustable portion 102 toward or away from the string 154. Thereby selectively modifying the length, tension, and diameter of the string 154 to modify tonal quality. If the adjustable portion 102 is moved away from the base portion 104, the length of the string(s) is increased along with a corresponding decrease in string 154 diameter. The result is a corresponding change of tonal quality. For example, the musical pitch is higher or lower than the initial tonal quality.

In an illustrative embodiment, the adjustment fasteners 120 are adjusted equally across the entire length of the adjustable portion 102. However, in another illustrative embodiment the adjustment fasteners 120 are adjusted unequally, either in value or direction, such that a variable force is applied across a string group. In this manner, a user may match or correlate string properties (such as manufactured materials, size, shape, etc.) to a desired tonal quality simply by varying the adjustment fastener 120 settings.

In another illustrative embodiment, at least one bias element 121 is employed. The biasing element 121 is a mechanical fastening devise similar to or the same as adjustment fastener 120. In an illustrative embodiment the biasing element 121 is a machine screw or similar fasting device. The biasing element 121 extends through the adjustable portion 102 and connects with base portion 104 via bias element bore 131. In an illustrative embodiment, the biasing element 121 serves to provide more rigidity to and reduce undesirable vibration of the adjustable portion 102, especially when not fully seated in the base portion 104. In use, the adjustable portion 102 is set at a desired height relative to the base portion 104 via the adjustment fastener 120. The biasing element 121 is then used apply a desired bias force against the adjustment fastener 120 and adjustable portion 102. As depicted in the Figures, only one biasing element 121 is shown. However, use of two or more biasing elements is within the scope of this disclosure.

Concerning material choices for the adjustable zero fret assembly 100, the bulk of the adjustable zero fret assembly 100 can be made of any suitably durable and hard material. Any variety of known metals, metal alloys, composites, bone, and suitable polymer based materials are within the scope of this disclosure provided they have adequate properties. Also, there may be selective materials choices, either for the device entirely or at selective positions of the adjustable zero fret assembly 100. For example, those portions of the seat 114 and crown 118 that contact the strings are made of a material that matches the string material while the remaining assembly 100 is constructed from another material. For example, a contact surface of the seat 114 may be made of the same or similar material as the outer surface of the string while the remaining assembly is of another material. In this manner, a user may achieve a desired tonal modification, while keeping such things as cost or weight within acceptable parameters. The selection and arrangement of the material choice is another unique aspect of this disclosure and is not intended to be a limiting factor.

Figure 9:
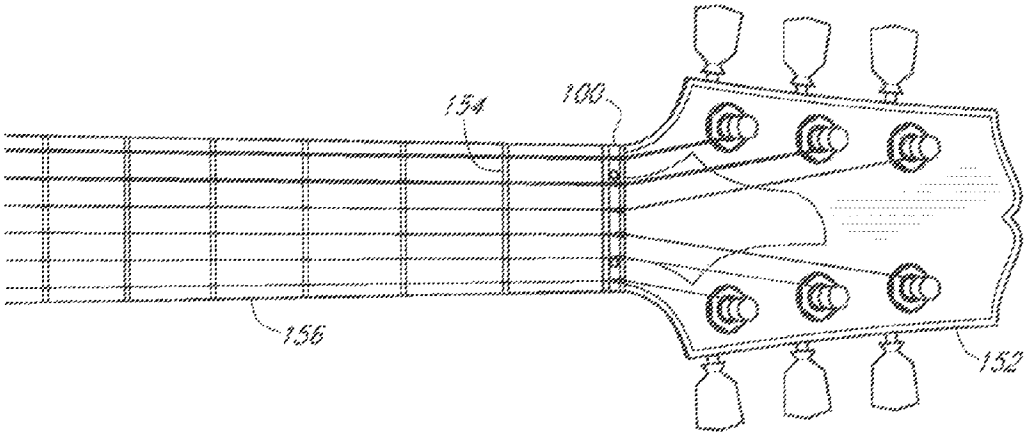
FIG. 9 is a top view of the adjustable zero fret assembly of FIG. 1 in use with a guitar; and, FIG. 10 is a side view of the adjustable zero fret assembly of FIG. 1 in use with a guitar.
Figure 10:
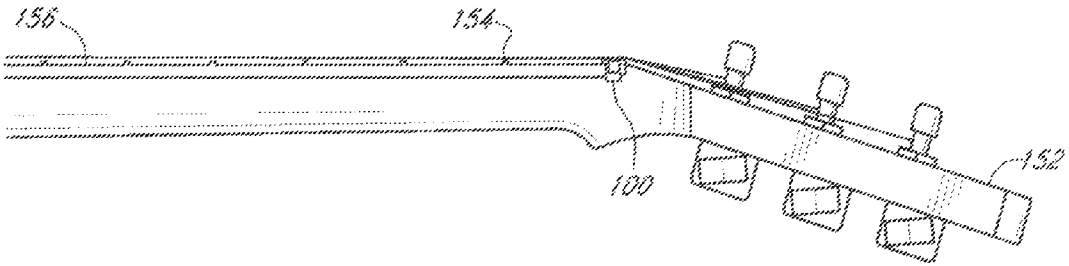

With reference to FIGS. 9 and 10, one method of using the adjustable zero fret assembly 100 is depicted. In this particular, non-limiting embodiment, the adjustable zero fret assembly 100 is shown in use with a guitar 150. As depicted, the adjustable zero fret assembly 100 is positioned adjacent the headstock 152. However, it will be appreciated that the positioning of the adjustable zero fret assembly 100 is variable dependent upon how a user prefers to use the device. Such placement of the device shall not limit the scope of this disclosure. Additionally, as discussed above, this device is not limited to a guitar 150, but rather to any stringed instrument.

ILLUSTRATIVE EMBODIMENTS

1. An adjustable zero fret assembly for a stringed instrument, comprising:

(a) a base portion, said base portion defining a substantially U-shaped locator channel extending substantially a length of the base portion; and (b) a single piece adjustable portion selectively movable relative to said base portion along a locator post formed in the single piece adjustable portion, said locator post being configured to engage the locator channel; said single piece adjustable portion including at least one seat portion for receiving a string of the stringed instrument, said at least one seat portion having a contact surface, and;

(c) a mechanical device for selectively moving the adjustable portion either toward or away from the base portion.

2. The assembly of Claim 1, wherein the mechanical device for selectively moving the adjustable portion includes at least two threaded mechanical members extending through the adjustable portion and configured to contact the base portion.

3. The assembly of Claim 2, wherein the threaded mechanical members are machine screws.

4. The assembly of Claim 1, wherein the adjustable portion is constructed from at least one of a metal, metal alloy, composite, or bone.

5. The assembly of Claim 4, wherein the contact surface is constructed from the same material as the adjustable portion.

6. The assembly of Claim 4, wherein the contact surface is constructed from a different material as the adjustable portion.

7. A method of varying the tonal quality of a stringed instrument, comprising:

(a) providing a stringed instrument having at least two strings playable to produce a tonal sound, said stringed instrument having an initial tonal quality;

(b) providing a two piece adjustable zero fret assembly adjacent the at least two strings, said two piece adjustable zero fret assembly including a base portion having a substantially U-shaped locator channel formed in the base portion and extending substantially a length of the base portion, and a single piece adjustable portion having a locator post formed in the single piece adjustable portion, said locator post being configured to engage the locator channel, the single piece adjustable portion being selectively moveable relative to the base portion;

(c) providing a biasing force to the at least two strings by selectively moving single piece adjustable portion in a direction toward or away from the at least two strings to produce a second tonal quality.

8. The method of Claim 7, wherein providing the biasing force is conducted via at least two threaded mechanical members extending through the adjustable portion and configured to engage to contact the base portion.

9. The method of Claim 8, wherein the threaded mechanical members are machine screws.

10. The method of Claim 7, wherein the second tonal quality is either higher or lower than the first tonal quality.

11. A stringed instrument, comprising:

a body;

a neck having a first end and a second end, the neck being connected with the body adjacent the first end;

a head, the head being connected with the neck adjacent the second end;

at least one string extending between the head and the body, adjacent the neck;

a two piece adjustable zero fret assembly, comprising:

(a) a base portion, said base portion defining a locator channel extending substantially a length of the base portion; and (b) a single piece adjustable portion selectively movable relative to said base portion along a locator post formed in the single piece adjustable portion, said locator post being configured to engage the locator channel; said single piece adjustable portion including at least one seat portion for receiving a string of the stringed instrument, said at least one seat portion having a contact surface, and;

(c) a mechanical device for selectively moving the adjustable portion either toward or away from the base portion.

12. The instrument of Claim 11, wherein the mechanical device for selectively moving the adjustable portion includes at least two threaded mechanical members extending through the adjustable portion and configured to contact the base portion.

13. The instrument of Claim 12, wherein the threaded mechanical members are machine screws.

14. The instrument of Claim 11, wherein the adjustable portion is constructed from at least one of a metal, metal alloy, composite, or bone.

15. The instrument of Claim 14, wherein the contact surface is constructed from the same material as the adjustable portion.

16. The instrument of Claim 14, wherein the contact surface is constructed from a different material as the adjustable portion.

While various aspects of this disclosure have been illustrated and described, it will be appreciated that various changes can be made therein without departing from the spirit and scope of this disclosure. For example, without limitation, the base portion 104 and the adjustable portion 102 do not necessarily need to be substantially U-shaped and T-shaped, respectively. Other geometries may be used. Additionally, there may be more or fewer than the two adjustment fasteners 120 used to control movement of the adjustable portion 102 relative to the base portion 104. Further, other variations and modifications apparent to those skilled in the art may be made within the nature of this disclosure.

What is claimed is:

1. An adjustable zero fret assembly for a stringed instrument, comprising:

(a) a base portion, said base portion defining a substantially U-shaped locator channel extending substantially a length of the base portion; and (b) a single piece adjustable portion selectively movable relative to said base portion along a locator post formed in the single piece adjustable portion, said locator post being configured to engage the locator channel; said single piece adjustable portion including at least one seat portion for receiving a string of the stringed instrument, said at least one seat portion having a contact surface, and;

(c) a mechanical device for selectively moving the adjustable portion either toward or away from the base portion.

2. The assembly of claim 1, wherein the mechanical device for selectively moving the adjustable portion includes at least two threaded mechanical members extending through the adjustable portion and configured to contact the base portion.

3. The assembly of claim 2, wherein the threaded mechanical members are machine screws.

4. The assembly of claim 1, wherein the adjustable portion is constructed from at least one of a metal, metal alloy, composite, or bone.

5. The assembly of claim 4, wherein the contact surface is constructed from the same material as the adjustable portion.

6. The assembly of claim 4, wherein the contact surface is constructed from a different material as the adjustable portion.

7. A method of varying the tonal quality of a stringed instrument, comprising:

(a) providing a stringed instrument having at least two strings playable to produce a tonal sound, said stringed instrument having an initial tonal quality;

(b) providing a two piece adjustable zero fret assembly adjacent the at least two strings, said two piece adjustable zero fret assembly including a base portion having a substantially U-shaped locator channel formed in the base portion and extending substantially a length of the base portion, and a single piece adjustable portion having a locator post formed in the single piece adjustable portion, said locator post being configured to engage the locator channel, the single piece adjustable portion being selectively moveable relative to the base portion;

(c) providing a biasing force to the at least two strings by selectively moving single piece adjustable portion in a direction toward or away from the at least two strings to produce a second tonal quality.

8. The method of claim 7, wherein providing the biasing force is conducted via at least two threaded mechanical members extending through the adjustable portion and configured to engage to contact the base portion.

9. The method of claim 8, wherein the threaded mechanical members are machine screws.

10. The method of claim 7, wherein the second tonal quality is either higher or lower than the first tonal quality.

11. A stringed instrument, comprising:

a body;

a neck having a first end and a second end, the neck being connected with the body adjacent the first end;

a head, the head being connected with the neck adjacent the second end;

at least one string extending between the head and the body, adjacent the neck;

a two piece adjustable zero fret assembly, comprising:

(a) a base portion, said base portion defining a locator channel extending substantially a length of the base portion; and (b) a single piece adjustable portion selectively movable relative to said base portion along a locator post formed in the single piece adjustable portion, said locator post being configured to engage the locator channel; said single piece adjustable portion including at least one seat portion for receiving a string of the stringed instrument, said at least one seat portion having a contact surface, and;

(c) a mechanical device for selectively moving the adjustable portion either toward or away from the base portion.

12. The instrument of claim 11, wherein the mechanical device for selectively moving the adjustable portion includes at least two threaded mechanical members extending through the adjustable portion and configured to contact the base portion.

13. The instrument of claim 12, wherein the threaded mechanical members are machine screws.

14. The instrument of claim 11, wherein the adjustable portion is constructed from at least one of a metal, metal alloy, composite, or bone.

15. The instrument of claim 14, wherein the contact surface is constructed from the same material as the adjustable portion.

16. The instrument of claim 14, wherein the contact surface is constructed from a different material as the adjustable portion.

* * * * *